US007579929B2

(12) United States Patent
Hikino et al.

(10) Patent No.: US 7,579,929 B2
(45) Date of Patent: Aug. 25, 2009

(54) TRANSMISSION CIRCUIT, ANTENNA DUPLEXER, AND RADIO-FREQUENCY SWITCH CIRCUIT

(75) Inventors: Osamu Hikino, Yokohama (JP); Masashi Ohki, Kawasaki (JP); Hideaki Sunayama, Sagamihara (JP)

(73) Assignee: Hitachi Media Electronics Co., Ltd., Iwate-Ken (JP)

( * ) Notice: Subject to any disclaimer, the term of this patent is extended or adjusted under 35 U.S.C. 154(b) by 135 days.

(21) Appl. No.: 11/362,518

(22) Filed: Feb. 27, 2006

(65) Prior Publication Data

US 2006/0290447 A1 Dec. 28, 2006

(30) Foreign Application Priority Data

Jun. 22, 2005 (JP) ..... 2005-181402

(51) Int. Cl.
*H01P 1/213* (2006.01)
*H01P 5/12* (2006.01)

(52) U.S. Cl. ..... 333/134; 333/128; 333/129

(58) Field of Classification Search ..... 333/126–129, 333/132, 134

See application file for complete search history.

(56) References Cited

U.S. PATENT DOCUMENTS 5,146,191 A 9/1992 Mandai et al.
5,557,245 A * 9/1996 Taketa et al. ..... 333/116
5,847,628 A 12/1998 Uchikoba et al.
6,861,923 B2 * 3/2005 Kolehmainen et al. ..... 333/128
6,998,938 B2 * 2/2006 Lin et al. ..... 333/177
7,164,332 B2 * 2/2006 Lin et al. ..... 333/177

FOREIGN PATENT DOCUMENTS

DE 41 19 551 A1 1/1992
JP 5-29819 2/1993
JP 05-029819 2/1993

OTHER PUBLICATIONS

German office Action issued in corresponding German Patent Application No. DE 10 2006 008 500.0-0-35, dated May 30, 2007.

* cited by examiner

*Primary Examiner*—Robert Pascal
*Assistant Examiner*—Kimberly E Glenn
(74) *Attorney, Agent, or Firm*—McDermott Will & Emery LLP

(57) ABSTRACT

A small-sized, high-performance transmission circuit is provided which avoids degradation in transmission line characteristics caused by coupling, due to a transmission line and a leader electrode to an external electrode which are oppositely facing, of the electromagnetic field induced by the transmission line and the electromagnetic field induced by the leader electrode. In order to attain the aforementioned object, the present invention comprises a first shield layer which is a first ground electrode, a second shield layer which is a second ground electrode, and a spiral-shaped transmission line facing the first shield layer and the second shield layer which is disposed between the first shield layer and the second shield layer. The spiral portion of the transmission line, when viewed from the top face or the bottom face of the transmission line, is disposed on the inside of the first shield layer and the second shield layer.

8 Claims, 8 Drawing Sheets

TRANSMISSION CIRCUIT, ANTENNA DUPLEXER, AND RADIO-FREQUENCY SWITCH CIRCUIT

INCORPORATION BY REFERENCE

The present application claims priority from Japanese application JP 2005-181402 filed on Jun. 22, 2005, the content of which is herby incorporated by Reference into this application.

BACKGROUND OF THE INVENTION

The present invention pertains to a transmission circuit, an antenna duplexer, and a radio-frequency circuit.

Conventionally, there is proposed, as an example of a transmission line used in radio-frequency circuits, one where a meander-shaped line and a shield electrode are disposed inside a laminated substrate.

There is also proposed a delay line, comprising a spiral-shaped coil conductor and a shield electrode formed on top and bottom of the coil conductor so as to face this coil conductor through a dielectric ceramic layer, and formed with a strip line structure between the coil conductor and the shield electrode (e.g. JP-A-05-029819 (Patent Document 1)).

SUMMARY OF THE INVENTION

However, in the aforementioned technology where a meander-shaped transmission line and a shield electrode are disposed inside a laminated substrate, the characteristic impedance of the line is determined by the width of the meander-shaped line and the distance between the meander-shaped line and the shield electrode. In other words, as shown in FIG. 11, in case one tries to obtain a higher impedance, the component becomes bigger since the distance between a meander-shaped line 18 and shield electrodes 17, 19 increases. Also, since the phase difference depends on the length of meander-shaped line 18, in case one tries to obtain a big phase difference, the component again becomes bigger. In addition, since the width of meander-shaped line 18 becomes narrower, the line resistance increases, so there is a risk of degradation in the characteristics. Moreover, since, for meander-shaped line 18, the directions in which the electric current is flowing in adjacent conductor portions are opposite, the impedance parts between adjacent conductor portions offset each other, so there is also a risk that the overall impedance decreases.

Also, in the delay line mentioned in the aforementioned Patent Document 1, the spiral-shaped coil conductor and the leader electrode to an external electrode face each other so there arises a cross-over part, or the outer part of the spiral-shaped coil conductor and the projected arrangement of the outer part of a shield electrode formed between the leader electrodes to the external electrodes coincide. In addition, the spiral-shaped coil conductor and the external electrode face each other. For this reason, since the electromagnetic field induced by the coil conductor and the electromagnetic field induced by the leader electrode are coupled, there is a risk that the characteristics of the transmission line are degraded. In other words, if there is a cross-over part, there occurs resonance due to the coupling capacitance between the input and output of the transmission line and the impedance of the transmission line, so there is a risk that operation in the radio-frequency domain becomes difficult.

Also, since coil conductors are laminated extending through several layers and are further connected by via holes so that an even longer delay time is obtained, the directions in which the electric current is flowing in the top-down adjacent conductor portions become opposite and the impedance portions of each coil conductor offset each other, so there is also a risk that the overall impedance ends up decreasing. For this reason, at operating frequencies from 0.5 GHz to 1 GHz used in actual products, i.e. SAW (Surface Acoustic Wave) filters or FBAR (Film Bulk Acoustic Resonator) filters mounted in mobile communication terminals, it becomes difficult to phase shift transmission signals 90° or more, so it becomes impossible to operate the mobile communication terminal accurately.

Moreover, in the case of using an antenna duplexer using SAW filters or FBAR filters and the like, the size of the antenna duplexer ends up being larger, since it is necessary to connect the terminals of these filters and the external terminals of the delay lines through a printed circuit board or the like.

In order to attain the aforementioned object, the present invention comprises a first shield layer being a first ground electrode, a second shield layer being a second ground electrode, a spiral-shaped transmission line facing the first shield layer and the second shield layer and disposed between the first shield layer and the second shield layer. The spiral portion of the transmission line is disposed on the inside of the first shield layer and the second shield layer when viewed from the top face or the bottom face of the transmission line.

According to the present invention, it becomes possible to provide, with improved transmission characteristics, a transmission line, an antenna duplexer, and a radio-frequency switch circuit.

BRIEF DESCRIPTION OF THE DRAWINGS

These and other features, objects and advantages of the present invention will become more apparent from the following description when taken in conjunction with the accompanying drawings wherein.

DESCRIPTION OF THE EMBODIMENTS

In the embodiments of the present invention, an explanation will be made choosing as an example a transmission line using a radio frequency circuit dielectric substrate of LTCC (Low Temperature Co-fired Ceramic), HTCC (High Temperature Co-fired Ceramic), or the like. Also, this transmission line will be explained as being used in a radio-frequency circuit for nearly 0.5 GHz or more, used in antenna duplexers, antenna switches, front end modules, and the like, using SAW (Surface Acoustic Wave) filters or FBAR (Film Bulk Acoustic Resonator) filters or the like. Below, the embodiments of the present invention will be explained by using the drawings.

Figure 1A:
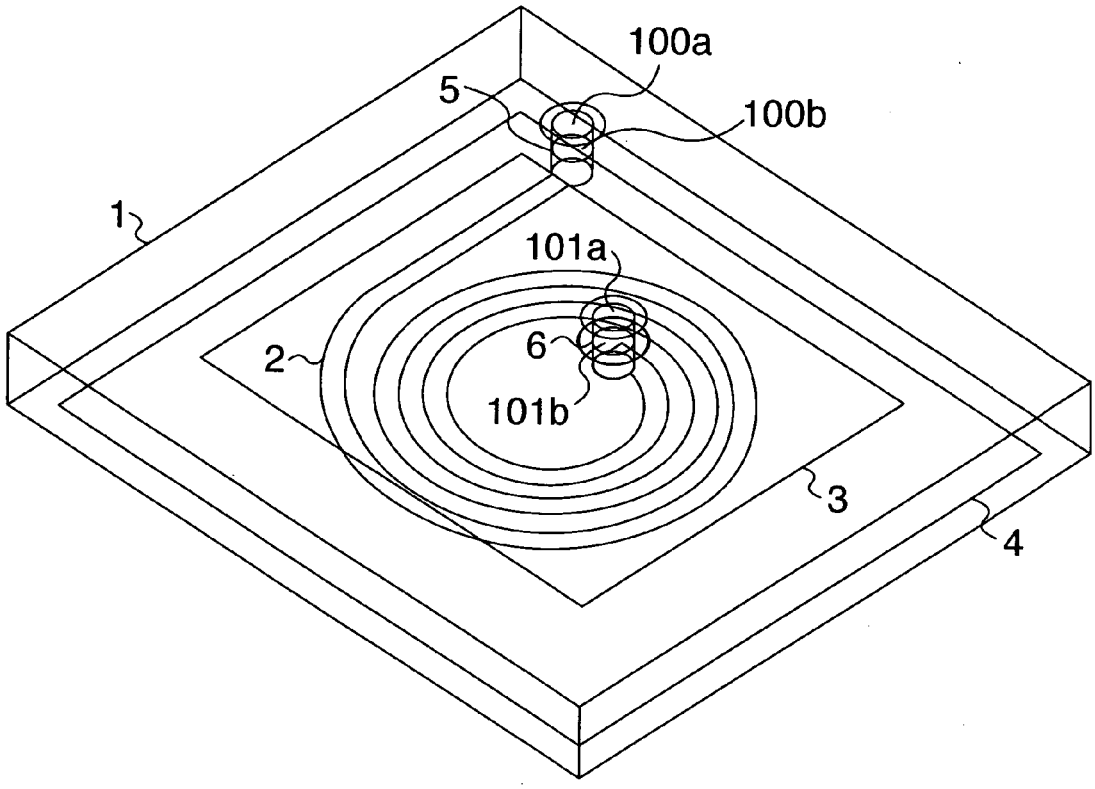
FIG. 1A is transparent perspective view of a transmission line related to the first embodiment of the present invention.
Figure 1B:
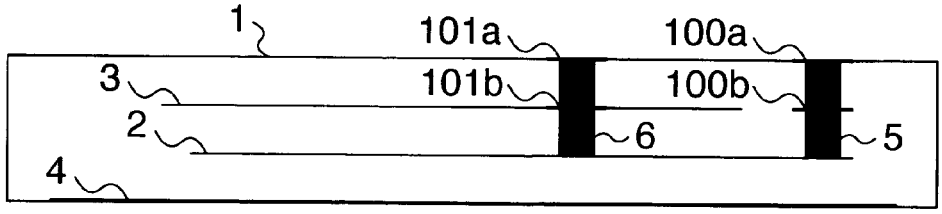
FIG. 1B is a transparent side elevational view of a transmission line related to the first embodiment of the present invention.
Figure 1C:
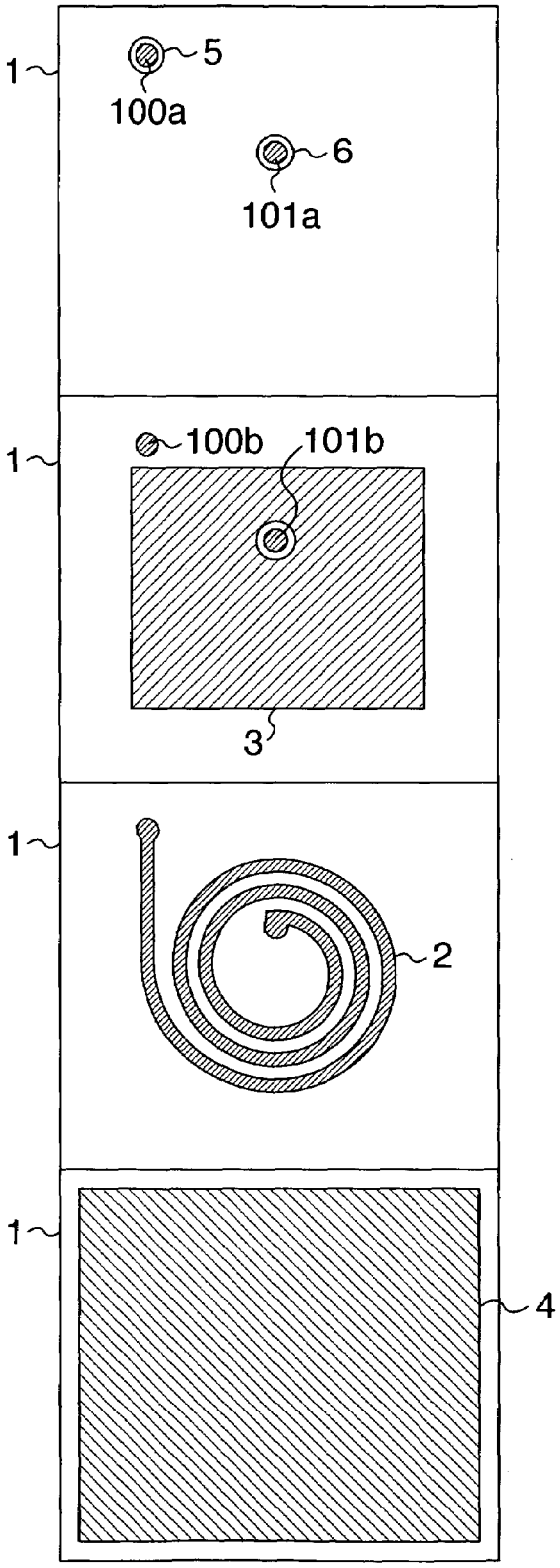
FIG. 1C is an electrode pattern view of a transmission line related to the first embodiment of the present invention.

FIGS. 1A, 1B, and 1C show, respectively a transparent perspective view, a transparent side elevational view, and an electrode pattern view for each layer, of a transmission line related to Embodiment 1 of the present invention. A dielectric multi-layer substrate 1 consists of e.g. LTCC, HTCC, or the like. As shown in FIG. 1, a transmission line 2 is formed on the inside of dielectric multi-layer substrate 1.

Transmission line 2 forms a path with a circular shaped spiral structure. A ground electrode 3 and a ground electrode 4 are disposed to cover transmission line 2, in the layer below transmission line 2 and in the layer below transmission line 2, respectively.

A land area 5 disposed on the surface of dielectric multi-layer substrate 1 is connected by means of via holes 100*a*, 100*b* to one end of transmission line 2, the other end of transmission line 2 being connected by means of via holes 101*a*, 101*b* to a land area 6 disposed on the surface of dielectric substrate 1. Specifically, land areas 5 and 6 on the surface disposed at the top face of dielectric multi-layer substrate 1 serve respectively as the input and output ends of the transmission line of Embodiment 1.

Figure 2:
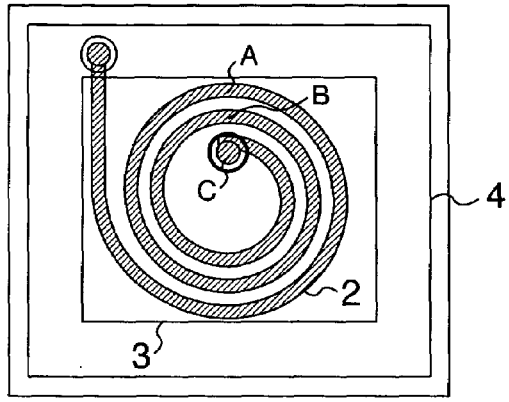
FIG. 2 is a transparent view from the top, of the electrode pattern of each layer of a transmission line related to the first embodiment of the present invention.

FIG. 2 shows a transparent view from the top of the electrode pattern of each layer of the transmission line related to Embodiment 1. As shown in FIG. 2, transmission line 2 is disposed so as to be covered by ground electrode 3 and ground electrode 4. Consequently, Part A and Part B are situated on the inside of ground electrode 3 and ground electrode 4, so cross-over does not occur, either between Part C and Part A, or between Part C and Part B. In other words, even in the case of disposing a leader line making a connection to the outside from Part C, the output end of transmission line 2, the result is that electromagnetic field coupling can be prevented, since ground electrode 3 is disposed between the leader line and transmission line 2 (specifically Part A and Part B). I.e., as for the output end of transmission line 2, since it is possible to prevent electromagnetic field coupling with any portion between the input end and the output end of transmission line 2, even at radio frequencies, the degradation of transmission characteristics can be prevented and excellent transmission characteristics can be obtained.

Further, in the configuration of the present embodiment, ground electrodes 3, 4 are chosen to have a configuration which adequately covers the spiral-shaped portion of transmission line 2. It is because there is too much harmful influence of electric fields and magnetic fields to remove and there is a risk of bringing about a degradation in the transmission characteristics in case the spiral-shaped portion is not adequately covered, e.g. in case the spiral-shaped portion protrudes from the range covered by ground electrodes 3, 4. Also, in case the spiral-shaped portion has nearly the same size as ground electrodes 3, 4, because magnetic fields come entering by turning around, there is likewise a risk of a deterioration in the transmission characteristics. Consequently, it becomes necessary to choose a configuration devised so that ground electrodes 3, 4 cover the spiral-shaped portion of transmission line 2 sufficiently widely to adequately reduce the influence of the electric fields and the magnetic fields.

Moreover in the present configuration, it is possible to obtain desired impedance characteristics in a desired frequency domain by regulating the capacitance component between ground electrodes 3, 4 and transmission line 2, and the inductance component due to the circular shaped spiral structure with no transmission line 2 cross-over part.

According to the present embodiment, since it is possible, through the impedance component and the capacitance component due to the circular shaped spiral structure with no cross-over part, constituted by transmission line 2 and ground electrodes 3, 4, to obtain a much bigger phase shift than the phase shift that can be obtained by the length of the strip line alone, a transmission line with an extremely small structure can be constituted. Also, for the transmission line of the present embodiment, the phase shift per single layer can be increased and the number of layers constituting the line can be reduced. Therefore, the size of the transmission line can be made smaller and thinner. Moreover, by reducing the number of discontinuity points of the line due to connections of the line and the via holes, it is possible to reduce the losses as well as provide a transmission line with small variations due to lamination layer slippage.

Figure 3A:
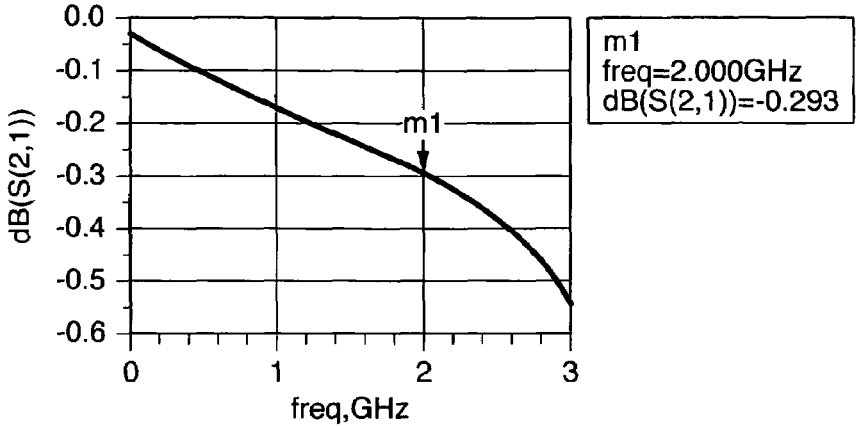
FIGS. 3A, 3B, and 3C show respectively the amplitude characteristics, the phase characteristics, and the reflection characteristics from the input end to the output end of a transmission line related to the first embodiment of the present invention.
Figure 3B:
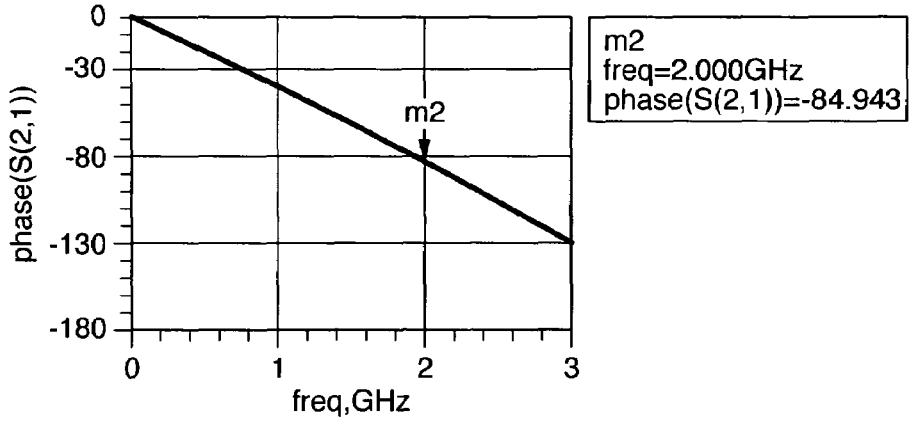
Figure 3C:
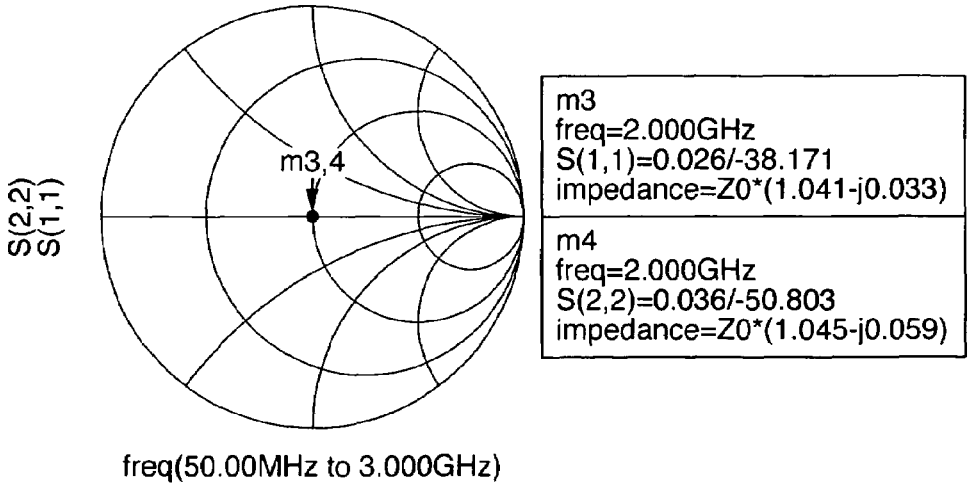

FIGS. 3A, 3B, and 3C respectively show the amplitude characteristics, the phase characteristics, and the reflection characteristics from input end land area 5 to output end land area 6 of a transmission line related to Embodiment 1. According to these diagrams, the transmission line related to the present embodiment, at 2 GHz, has a transit loss of 0.3 dB, a phase shift of 85°, and an impedance of 50Ω. That is to say that the transmission line constitutes an excellent, low-loss $\lambda/4$ transformer in the vicinity of the 2-GHz band.

Figure 4:
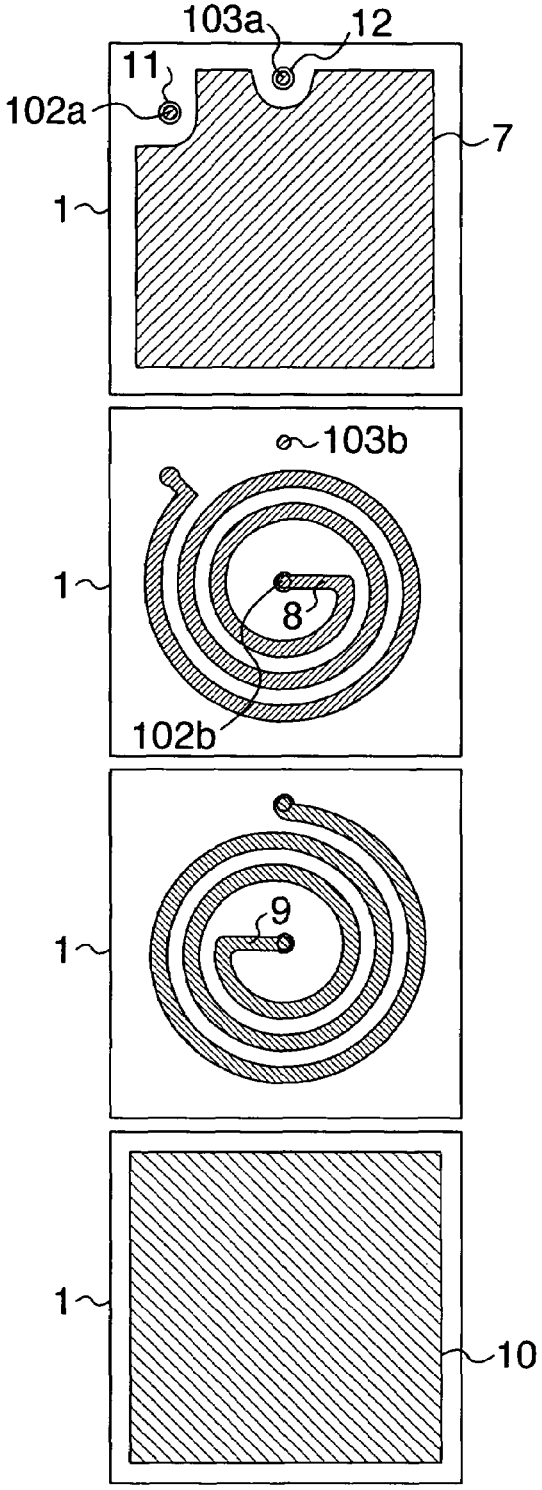
FIG. 4 is an electrode pattern view of a transmission line related to the second embodiment of the present invention.

FIG. 4 shows an electrode pattern diagram of each layer of a transmission line related to Embodiment 2 of the present invention.

In the present embodiment, on the inside of a dielectric multi-layer substrate 1, a first transmission line 8 is formed, and in the layer below first transmission line 8, a second transmission line 9 is formed. First transmission line 8 and second transmission line 9 respectively have a circular shaped spiral structure, the connection of first transmission line 8 and second transmission line 9 being carried out with a via hole 102*b* to constitute a transmission line spanning multiple layers.

Ground electrode 7 and ground electrode 10 are disposed, respectively, in the layer above first transmission line 8 and the layer below above second transmission line 9, to cover first transmission line 8 and second transmission line 9.

A land area 11 disposed on the surface of dielectric multi-layer substrate 1 is connected to one end of first transmission line 8 by means of a via hole 102*a*, and the other end of first transmission line 8 is connected to one end of second transmission line 9 by means of via hole 102*b*, the other end of second transmission line 9 being connected to a land area 12 disposed on the surface of dielectric substrate 1 by means of via holes 103*b*, 103*a*. Specifically, land areas 11 and 12 disposed on the surface of dielectric multi-layer substrate 1 are the input and output ends of the transmission line of Embodiment 2. According to the present configuration, since the result is that the electric current flowing through the transmission line of the present embodiment has nearly the same direction (a counter-clockwise direction) in first transmission line 8 and second transmission line 9, the impedance component of transmission line 8 and the impedance component of transmission line 9 are not offset. Consequently, it is possible to be able to obtain a big impedance component for the transmission line as a whole. In accordance with the present transmission line, the operating frequency of the transmission line can be lowered, since it is possible to obtain a big phase shift without increasing the product dimensions.

Figure 5:
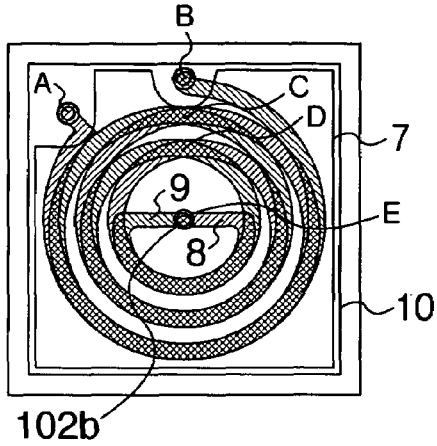
FIG. 5 is a transparent view from the top, of the electrode pattern of each layer of a transmission line related to the second embodiment of the present invention.

FIG. 5 is a transparent view from the top, of the electrode pattern of each layer of the transmission line related to Embodiment 2. As shown in FIG. 5, first transmission line 8 and second transmission line 9 are disposed to be covered by ground electrode 7 and ground electrode 10. Accordingly, be it in Part C or Part D, transmission line 8 and transmission line 9 are situated on the inside of ground electrode 7 and ground electrode 10, so there occurs no cross-over, either between Parts C, D and Part A, or between Parts C, D and part B. That is to say that for the input end of first transmission line 8 and the output end of second transmission line 9, excellent transmission line characteristics can be obtained, since it is possible to prevent electromagnetic field coupling, even at radio frequencies, for any portion between the input end of the transmission line constituted by first transmission line 8 and second transmission line 9 and the output end.

Also, in the present configuration, by regulating the capacitance components between ground electrodes 7, 10 and first transmission line 8 and second transmission line 9, and the inductance components due to the circular shaped spiral structure with no cross-over of first transmission line 8 and second transmission line 9, it is possible to obtain desired impedance characteristics in the desired radio frequency band.

According to the present embodiment, since it is possible, through the inductance component and the capacitance component due to the circular shaped spiral structure with no cross-over constituted by first transmission line 8 and second transmission line 9 and ground electrodes 7, 10, to obtain a much bigger phase shift than the phase shift that can be obtained by the length of the strip line alone, a transmission line with an extremely small structure can be constituted. Also, for the transmission line of the present embodiment, the phase shift per single layer can be increased and the number of layers constituting the line can be reduced. Therefore, the transmission line can be reduced in size and made thinner.

Figure 6A:
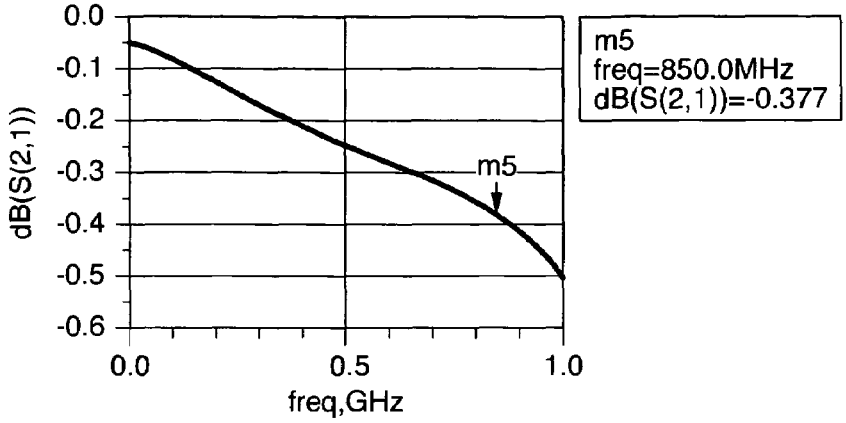
FIGS. 6A, 6B, and 6C show respectively the amplitude characteristics, the phase characteristics, and the reflection characteristics from the input end to the output end of a transmission line related to the second embodiment of the present invention.
Figure 6B:
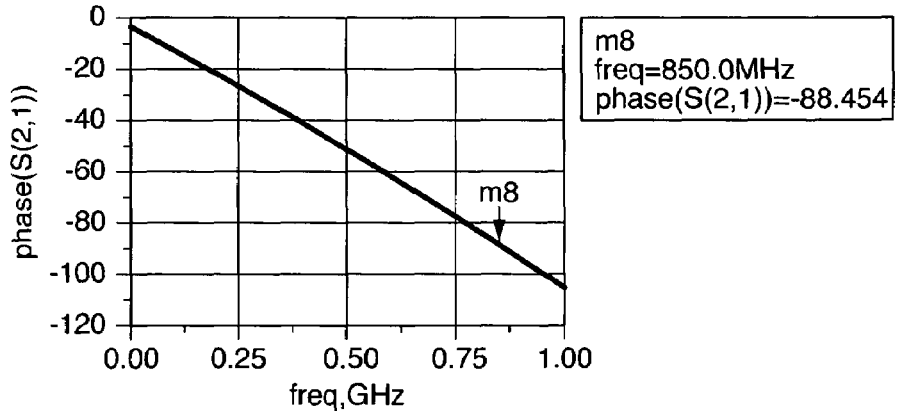
Figure 6C:
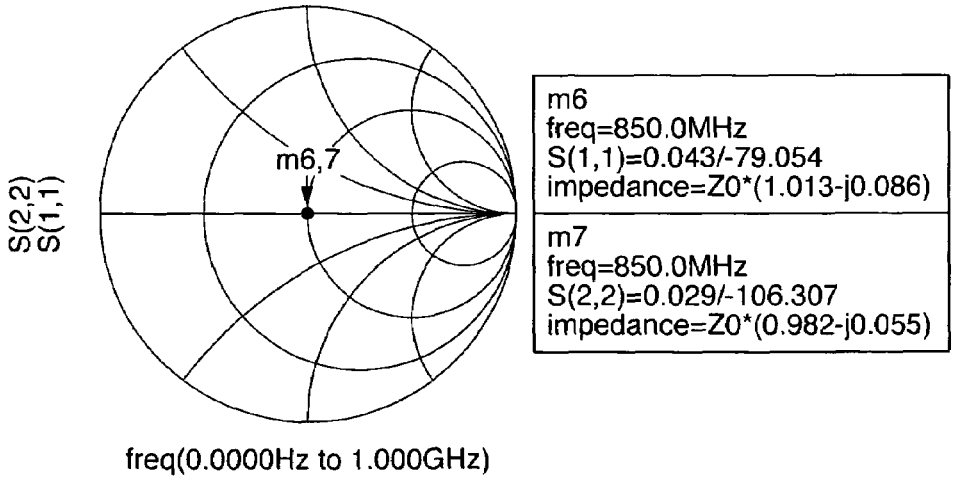

FIGS. 6A, 6B, and 6C show respectively the amplitude characteristics, the phase characteristics, and the reflection characteristics from input end land area 11 to output end land area 12 of the transmission line related to Embodiment 2. According to these diagrams, the transmission line of the present embodiment, at 850 MHz, has a transit loss of 0.4 dB, a phase shift of 88°, and an impedance of 50Ω. That is to say that this transmission line constitutes an excellent, low-loss λ/4 transformer in the vicinity of the 850-MHz band.

In the aforementioned embodiment, there were connected transmission lines 8 and 9, having a circular shaped spiral structure with no cross-over part and spanning two layers on the inside of a dielectric multi-layer substrate, but the present invention is not limited thereto, it also being possible to connect a circular shaped spiral structure having no cross-over part, so that the electric current flows in the same direction in three or more layers.

Figure 7:
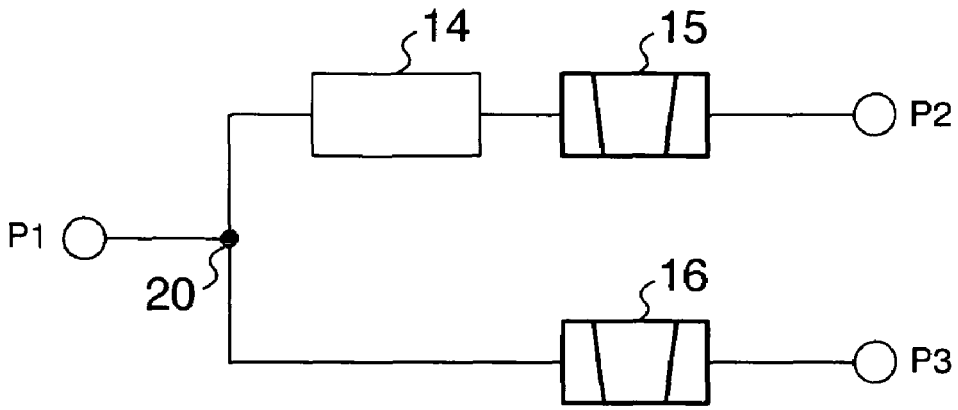
FIG. 7 is a circuit diagram of an antenna duplexer using a transmission line, related to the third embodiment of the present invention, as an impedance converter 14.

FIG. 7 is a circuit diagram of an antenna duplexer using a transmission line, related to the Embodiment 3 of the present invention, as an impedance converter 14. In the present antenna duplexer, P1 is an antenna terminal, P2 is a reception terminal, and P3 is a transmission terminal. Terminal P2 is connected to a Surface Acoustic Wave filter 15 for reception, and terminal P3 is connected to Surface Acoustic Wave filter 16 for transmission. Moreover, the reception side and the transmission side are connected in parallel at a parallel connection point 20. When the reception side and the transmission side are connected in parallel, and by setting the transmission frequency band impedance taken from parallel connection point 20 on the reception side to be a high impedance and, also, taking the reception frequency band impedance taken from parallel connection 20 on the transmission side to be a high impedance, there is a need to reduce the respective entry by leakage of the received signals and the transmitted signals. In this way, the antenna duplexer, which uses a single antenna to combine signals with different frequencies, is connected to the antenna of the communication device. In other words, this antenna duplexer is capable of combining the transmission and reception of signals with multiple frequencies.

Impedance converter 14 of the present embodiment is connected between parallel connection point 20 and Surface Acoustic Wave filter 15 for reception. Specifically, the impedance seen from parallel connection point 20 of Surface Acoustic Wave filter 15 for reception is converted into a high impedance in the transmission band by impedance converter 14. Also, since the impedance seen from parallel connection point 20 of Surface Acoustic Wave filter 16 for transmission has become a high impedance in the reception band, reception filter 15 and transmission filter 16 are connected with little entry by leakage of each other's signals. In addition, since the impedance of impedance converter 14 is nearly 50Ω in the reception band, the radio-frequency signals in the reception frequency band are transmitted from terminal P1 to terminal P2 with little degradation in characteristics. Consequently, by using this impedance converter 14, it is possible to provide a high-performance antenna duplexer.

The reception filter and transmission filter used in the aforementioned embodiment are not limited to Surface Acoustic Wave filters, and it is e.g. possible to apply filters based on another method such as FBAR filters.

Figure 8:
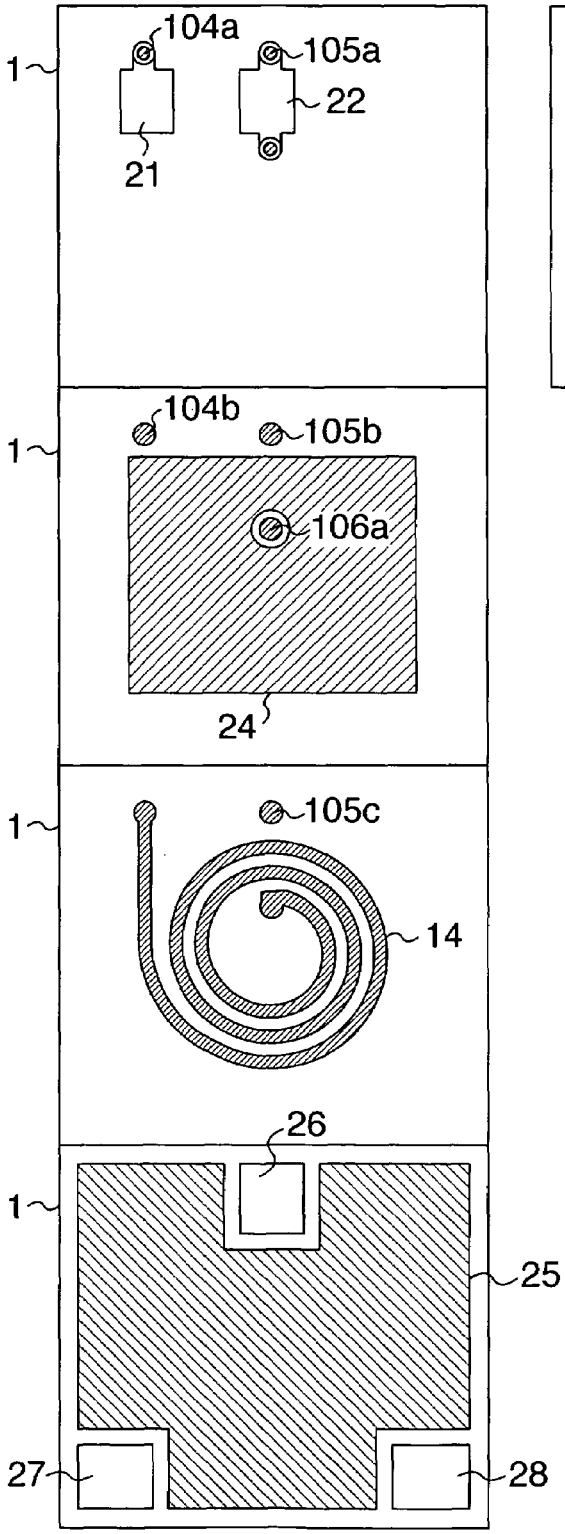
FIG. 8 is a diagram of the electrode pattern of each layer of an antenna duplexer, of the fourth embodiment of the present invention, using the impedance converter of the present invention.

FIG. 8 shows a view of the electrode patterns of each layer of an antenna duplexer of Embodiment 4 of the present invention using the impedance converter. As shown in FIG. 8, on the inside of dielectric multi-layer substrate 1, there is formed a transmission line 14 of the aforementioned embodiment. A ground electrode 24 and a ground electrode 25 are disposed in the layer above transmission line 14 and in the layer below transmission line 14, respectively, to cover transmission line 14. In the lowest layer of dielectric multi-layer substrate 1, there are provided pads for external output ends, terminal 26 being an antenna terminal, terminal 27 being a reception terminal, and terminal 28 being a transmission terminal. A land area 21 disposed on the surface of dielectric multi-layer substrate 1 is connected to one end of transmission line 14 by means of via holes 104*a*, 104*b*, and the other end of transmission line 14 is connected to a surface land area 22 disposed on the top face of dielectric multi-layer substrate 1 by means of via hole 106*a*. Moreover, surface land area 22 disposed on the top face of dielectric multi-layer substrate 1 is connected to antenna terminal 26 by means of via holes 105*a*, 105*b*, 105*c*.

Figure 9:
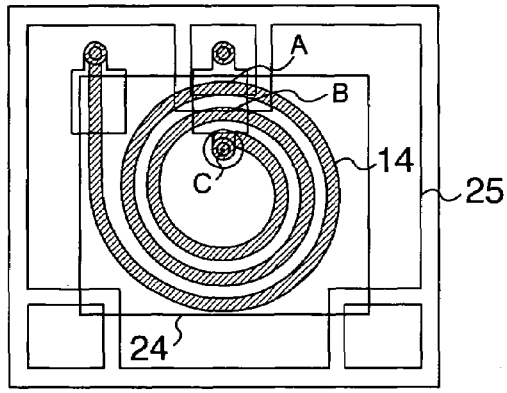
FIG. 9 is a transparent view from the top, of each layer of an antenna duplexer of the fourth embodiment of the present invention using the impedance converter of the present invention.
Figure 11:
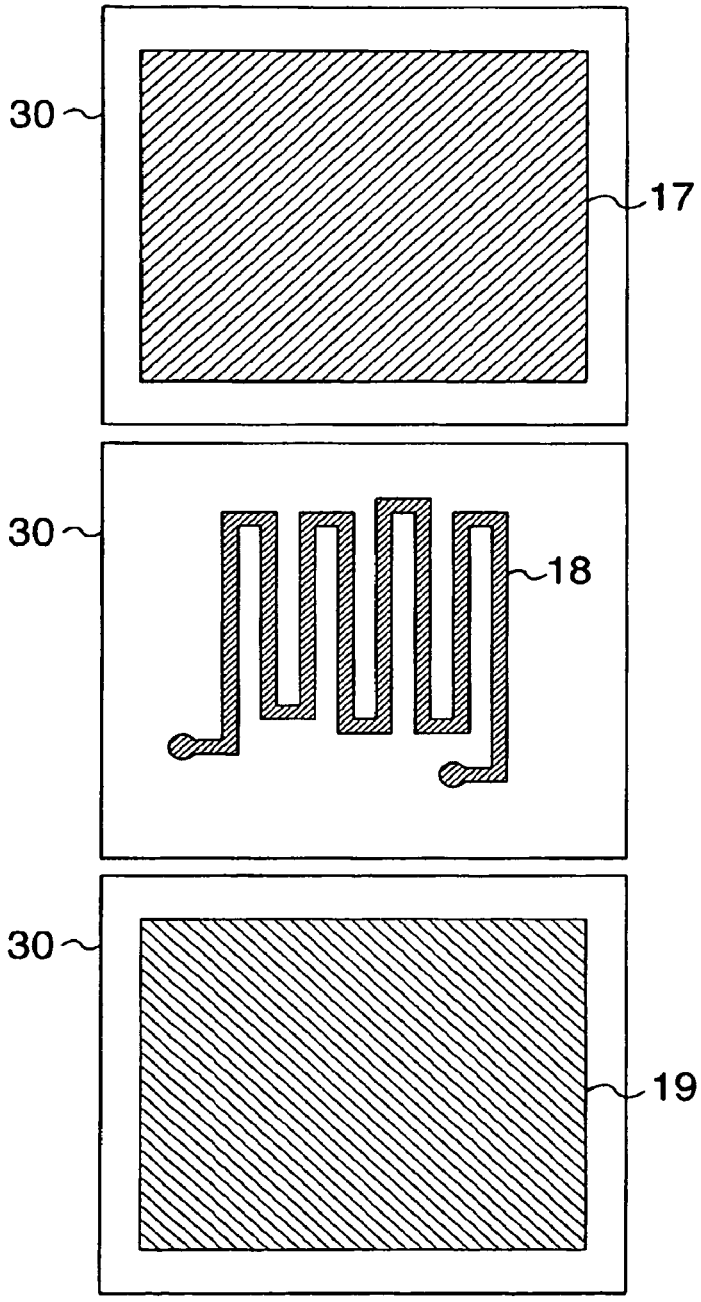
FIG. 11 (CONVENTIONAL ART)
FIG. 11 is a view showing the structure of a conventional impedance transmission line.

FIG. 9 is a transparent view from the top of each layer of an antenna duplexer of Embodiment 4 of the present invention using an impedance converter. As shown in FIG. 9, transmission line 14 of the aforementioned embodiment is disposed so as to be covered by ground electrode 24 and ground electrode 25. Consequently, even in Part A and Part B, transmission line 14 is situated on the inside of ground electrode 24 and ground electrode 25, so cross-over does not occur, either between Part C and Part A, or between Part C and Part B. That is to say that for the output end of transmission line 14, the degradation of transmission characteristics can be prevented and excellent transmission characteristics can be obtained, since it is possible to prevent electromagnetic field coupling with any portion between the input end and the output end of transmission line 14, even at radio frequencies.

Figure 10:
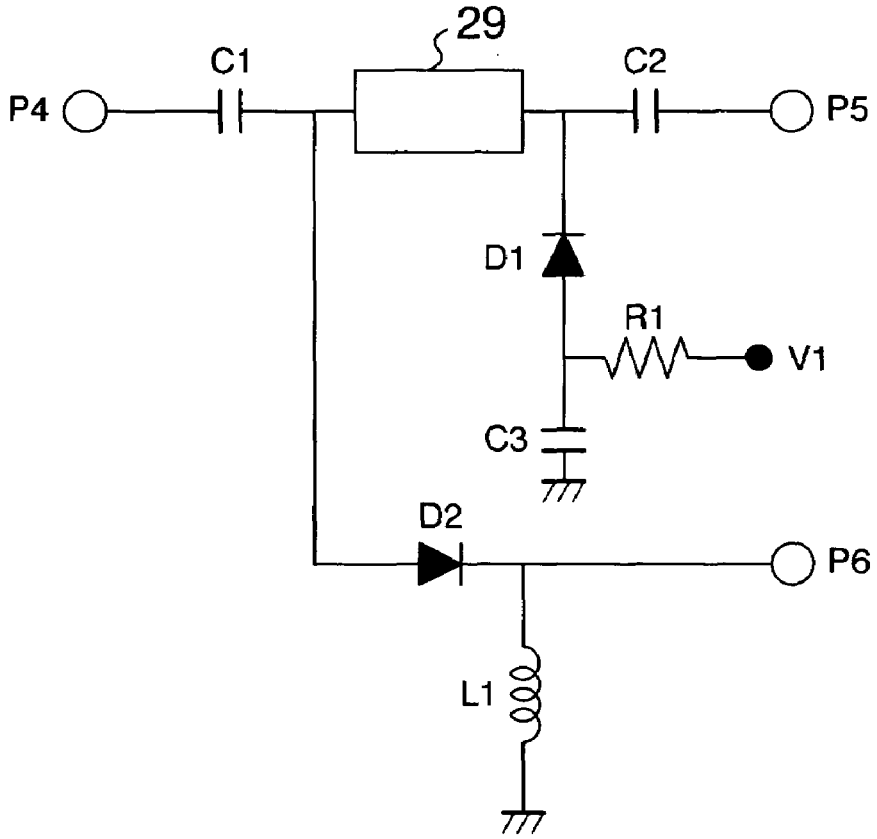
FIG. 10 is a circuit diagram of a radio-frequency switch, of the fifth embodiment of the present invention, using an impedance converter.

FIG. 10 is a circuit diagram of a radio-frequency switch of Embodiment 5 of the present invention using an impedance converter. This radio-frequency switch circuit is a radio-frequency switch circuit which takes a terminal P4 to be the input terminal and, at a frequency fs, selects a terminal P5 to be the output terminal when the bias voltage of terminal V1 is turned off and selects a terminal P6 to be the output terminal when the bias voltage of terminal V1 is turned on.

By applying a voltage on terminal V1, a direct electric current flows through a resistance R1, diodes D1, D2 enter the ON state, and the direct electric current is fed back by passing though an inductance L1. At this point, if a resonant frequency determined by a parasitic capacitance C3 of the diode is set to the vicinity of frequency fs, the output terminal (on the side of direct current blocking capacitance C2) of a transmission line 29 in the aforementioned embodiment is grounded in the vicinity of frequency fs. At this point, radio-frequency signals flow from terminal [P]4 to terminal P6, since the phase shift is 90° at frequency fs in transmission line 29, because high impedance results at frequency fs at the input terminal (on the side of direct current blocking capacitance C1) of transmission line 29. Also, when the bias voltage of terminal V1 is turned off, since diodes D1, D2 are off and the impedance of transmission line 29 is nearly 50Ω, the radio-frequency signals flow from terminal P4 to terminal P5. By using this transmission line 29, it is possible to obtain a small-sized radio-frequency switch circuit with high performance.

In Embodiment 5, an explanation was made concerning a λ/4 transformer at a specific frequency, but the invention is not limited to the frequency and impedance specifics shown in the embodiment, and can be applied with other frequencies and impedances.

Further, the transmission line, antenna duplexer and radio frequency switch circuit shown in each embodiment are elements which are used in communication terminals, starting with portable phones. In the communication terminals provided with these transmission lines, antenna duplexers or radio frequency switch circuits, it becomes possible to implement stable communications with higher reception sensitivity.

According to the technology described in the aforementioned embodiments mentioned above, by constituting a circular spiral shaped transmission line with no cross-over part inside a dielectric multi-layer substrate, it is possible to obtain excellent transmission line performance since it is possible to prevent electromagnetic field coupling of any portion between the input end and the output end of the transmission line.

Also, by making the shape of the transmission line circular, it is possible to prevent stagnation of the electric current flowing in the transmission line, and to reduce losses in the transmission line.

Moreover, by constituting the transmission line in multiple layers and choosing the electric current flowing in the transmission line to have the same direction in all the layers, since, for the overall transmission line, a big impedance part is obtained and a big phase shift can be obtained without an increase in the component dimensions.

Also, since the result is that the electric current flowing in adjacent conductors have the same direction, it is possible to obtain a big impedance part and to obtain stable characteristics without an increase in component dimensions, even in the frequency domain of 1 GHz or higher.

In addition, because it is possible to reduce the number of layers constituting the transmission line since the phase shift per single layer becomes bigger, there can be projected a miniaturization and a slimming of the transmission line, a reduction in the variations in characteristics due to lamination layer slippage, and a reduction in the transmission line losses due to a reduction in inter-layer connection points (a reduction in the number of transmission line discontinuity points).

Moreover, it is possible to apply the transmission line to an impedance converter and to provide a small-sized, high-performance radio-frequency circuit device such as an antenna duplexer, a radio-frequency switch circuit or the like.

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications within the ambit of the appended claims.

The invention claimed is:

1. A transmission circuit, comprising:

a dielectric substrate;

a spiral-shaped transmission line disposed in said dielectric substrate;

a first shield layer, being a first ground electrode, facing a top face of said spiral-shaped transmission line;

a second shield layer, being a second ground electrode, facing a bottom face of said spiral-shaped transmission line;

a first terminal part disposed at an inner circumference of said spiral-shaped transmission line;

a second terminal part disposed at an outer circumference of said spiral-shaped transmission line;

a third terminal part which lies above said first shield layer; and a fourth terminal part disposed on said dielectric substrate, wherein said first terminal part and said third terminal part are connected, wherein said second terminal part and said fourth terminal part are connected, and wherein said third terminal part is exposed to outside and so disposed that said first shield layer is between said third terminal part and a spiral part of said spiral-shaped transmission line.

2. The transmission circuit according to claim 1, wherein a leader line making a connection from said fourth terminal part to the outside is disposed on said dielectric substrate.

3. The transmission circuit according to claim 1, wherein the spiral portion of said transmission line, when viewed from the top face or the bottom face of said transmission circuit, is disposed on an inside of said first shield layer and said second shield layer.

4. The transmission circuit according to claim 1, wherein said first shield layer and said second shield layer, when viewed from the top face or the bottom face of said transmission circuit, cover the spiral portion of said transmission line in a wider range than said spiral portion.

5. An antenna duplexer comprising said transmission circuit according to claim 1, capable of combining transmission and reception of multiple-frequency signals.

6. A radio-frequency switch circuit, comprising said transmission circuit according to claim 1.

7. A transmission circuit, comprising:

a first spiral-shaped transmission line;

a second spiral-shaped transmission line, facing said first spiral-shaped transmission line and disposed on a bottom face of said first spiral-shaped transmission line;

a first shield layer, being a first ground electrode, facing said first spiral-shaped transmission line and disposed on a top face of said first spiral-shaped transmission line; and a second shield layer, being a second ground electrode, facing said second spiral-shaped transmission line and disposed on a bottom face of said second spiral-shaped transmission line, wherein an orientation of an electric current flowing in said first spiral-shaped transmission line and an orientation of an electric current flowing in said second spiral-shaped transmission line have nearly the same direction.

8. A transmission circuit, comprising a dielectric multi-layer substrate and a plurality of transmission lines each having a circular spiral structure, wherein: said plurality of transmission lines having a circular spiral structure are disposed inside said dielectric multi-layer substrate, each of said plurality of transmission lines is connected to each other, one or both of a top part of one of said plurality of transmission lines and a bottom of another of said plurality of said transmission lines are shielded with an electrode which is connected to ground, and directions, in all layers, of electric currents flowing in said plurality of transmission lines are chosen to be the same.

* * * * *